US005709718A

United States Patent [19]

Edwards

[11] Patent Number: 5,709,718

[45] Date of Patent: Jan. 20, 1998

[54] FUEL COMPOSITIONS CONTAINING A POLYETHER

[75] Inventor: Charles Lee Edwards, Houston, Tex.

[73] Assignee: Shell Oil Company, Houston, Tex.

[21] Appl. No.: 692,217

[22] Filed: Aug. 6, 1996

Related U.S. Application Data

[63] Continuation of Ser. No. 404,782, Mar. 15, 1995, abandoned.

[51] Int. Cl.[6] ..... C10L 1/24

[52] U.S. Cl. ..... 44/383; 44/435

[58] Field of Search ..... 44/383, 435

[56] References Cited

U.S. PATENT DOCUMENTS 2,862,804 12/1958 Petty .
2,889,213 6/1959 Larsen .
2,927,946 3/1960 Petty .
3,005,853 10/1961 Wilgus et al. .
3,156,649 11/1964 Hewett et al. .
3,240,703 3/1966 Symon et al. .
4,259,474 3/1981 Chakrabarti et al. .
4,298,352 11/1981 Blysing .
4,566,878 1/1986 Karol et al. .
4,575,569 3/1986 Edwards .
4,612,335 9/1986 Cuscurida et al. .
4,883,826 11/1989 Marugg et al. .
4,973,414 11/1990 Nerger et al. .
5,024,678 6/1991 Mertens-Gottselig et al. .
5,123,932 6/1992 Rath et al. .
5,283,368 2/1994 Shaw .

*Primary Examiner*—Jerry D. Johnson

[57] ABSTRACT

The present invention is directed to the use of sulfur-containing alkoxylate compounds as additives in fuel compositions having a mixture of a major amount of hydrocarbons in the gasoline boiling range and a minor amount of one or more of these compounds. The invention is also directed to the use of these compounds for decreasing intake valve deposits.

12 Claims, No Drawings

FUEL COMPOSITIONS CONTAINING A POLYETHER

This is a continuation of application Ser. No. 08/404,782, filed Mar. 15, 1995, now abandoned.

FIELD OF THE INVENTION

The present invention relates to the use of sulfur-containing compounds as additives in fuel compositions and the use of these compounds to decrease intake valve deposits.

BACKGROUND OF THE INVENTION

The accumulation of deposits on intake valves of internal combustion engines presents a variety of problems which are typically characterized by overall poor driveability including hard starting, stalls, and stumbles during acceleration and rough engine idle. A variety of additives are known which can be added to hydrocarbon fuels to prevent or reduce deposit formation, or remove or modify formed deposits, in the combustion chamber and on adjacent surfaces such as intake valves, ports, and spark plugs, which in turn causes a decrease in octane requirement.

Continued improvements in the design of internal combustion engines, e.g., fuel injection and carburetor engines, bring changes to the environment of such engines thereby creating a continuing need for new additives to control the problem of inlet system deposits and to improve driveability which is usually related to deposits.

SUMMARY OF THE INVENTION

The present invention is directed to the use of sulfur-containing compounds as additives in fuel compositions comprising a major amount of hydrocarbons in the gasoline boiling range and a minor amount of one or more sulfur-containing compounds of Formula I:

$$R_1\text{-S—}(R_2\text{-O}_x\text{-}(R_3\text{-O})_y\text{-H} \qquad \text{(I)}$$

wherein $R_1$ is selected from hydrogen, alkyl of 1 to 20 carbon atoms, acyl of 2 to 20 carbon atoms; aryl of 6 to 20 carbon atoms and polyoxyalkylene alcohol of Formula II:

$$\text{H-(O-}R_4)_z\text{-} \qquad \text{(II)}$$

wherein each $R_4$ is independently selected from alkyl of 2 to 20 carbon atoms and z is from 1 to 50; each $R_2$ is independently selected from alkyl of 2 to 20 carbon atoms; each $R_3$ is independently selected from alkyl of 2 to 20 carbon atoms; x is from 0 to 10; y is from 1 to 50 and the weight average molecular weight of the additive compound is at least 600. The invention is also directed to the use of these compounds for decreasing intake valve deposits.

DESCRIPTION OF THE PREFERRED EMBODIMENTS

The compounds of the present invention, broadly expressed as sulfur-containing alkoxylates, are a new class of additives useful for hydrocarbon fuels, e.g., fuels in the gasoline boiling range, for preventing deposits in engines, while also decomposing during combustion to environmentally acceptable products. The compounds produce very little residue and are miscible with carriers and other detergents. Non-limiting illustrative embodiments of the compounds useful as additives in the instant invention include those of Formula I:

$$R_1\text{-S-}(R_2\text{-O})_x\text{-}(R_3\text{-O})_y\text{-H} \qquad \text{(I)}$$

In Formula I, $R_1$ is selected from hydrogen, alkyl of 1 to 20 carbon atoms, acyl of 2 to 20 carbon atoms, aryl of 6 to 20 carbon atoms and polyoxyalkylene alcohol of Formula II:

$$\text{H-(O-}R_4)_z\text{-} \qquad \text{(II)}$$

wherein each $R_4$ is independently selected from alkyl of 2 to 20 carbon atoms and z is from 1 to 50.

When $R_1$ is alkyl of 1 to 20 carbon atoms, the alkyl may be linear or branched. Preferably, when $R_1$ is alkyl, it is alkyl of 1 to 12 carbon atoms, more preferably alkyl of 1 to 10 carbon atoms. Even more preferably $R_1$ is methyl.

In those instances when $R_1$ is acyl, the acyl will have a total of 2 to 20 carbon atoms. More preferably, when $R_1$ is acyl, it will be acyl of 2 to 8 carbon atoms. Suitably, the carbon atoms attached to the central carbon atom (i.e., those carbon atoms represented by A' in the formula $$\text{A'—}\underset{\underset{\text{O}}{\|}}{\text{C}}\text{—)}$$

may be linear, branched, or an unsubstituted or substituted aromatic.

When $R_1$ is aryl, it will preferably be aryl of 6 to 20 carbon atoms. More preferably, when $R_1$ is aryl, it will be aryl of 6 carbon atoms. In addition, the aryl may be unsubstituted or substituted in any manner.

$R_1$ can also be polyoxyalkylene alcohol of Formula II:

$$\text{H-(O-}R_4)_z\text{-} \qquad \text{(II)}$$

wherein each $R_4$ is independently selected from alkyl of 2 to 20 carbon atoms and z is from 1 to 50. Preferably each $R_4$ is independently selected from alkyl of 2 to 12 carbon atoms. Preferred compounds are those in which $R_4$ is alkyl of 2 to 4 carbon atoms, especially alkyl of 4 carbon atoms.

Particularly preferred compounds of Formula I are those in which when $R_1$ is polyoxyalkylene of Formula II, $R_4$ is alkyl (geminal or vicinal) of formula:

$$\text{—CH}_2\text{—}\overset{\overset{\text{R}_7}{|}}{\underset{\underset{\text{R}_5}{|}}{\text{C}}}\text{—} \qquad \text{(III)}$$

or $$\text{—}\underset{\underset{\text{R}_6}{|}}{\text{CH}}\text{—}\underset{\underset{\text{R}_5}{|}}{\text{CH}}\text{—} \qquad \text{(IV)}$$

wherein $R_5$, $R_6$ and $R_7$ are each independently selected from hydrogen and alkyl of 1 to 18 carbon atoms. In addition, $R_6$ and $R_5$, or alternatively $R_5$ and $R_7$, may be taken together to form a divalent linking alkyl group of 3 to 12 carbon atoms.

Preferred compounds of Formula I are those in which when $R_1$ is polyoxyalkylene alcohol of Formula II, each $R_4$ is alkyl as represented by Formula III above wherein $R_7$ is hydrogen and $R_5$ is independently selected from hydrogen and alkyl of 1 to 18 carbon atoms, particularly those compounds where $R_7$ is hydrogen and $R_5$ is independently hydrogen or alkyl of 1 to 2 carbon atoms, especially those compounds where $R_7$ is hydrogen and $R_5$ is alkyl of 2 carbon atoms.

In Formula II above, z is from 1 to 50, preferably from 1 to 40, and even more preferably from 1 to 26. Those of ordinary skill in the art will recognize that when the compounds of Formula I in which $R_1$ is polyoxyalkylene alcohol are used in a composition, z will not have a fixed value but will instead be represented by a range of different values. As used in this specification, z is considered to be a (number) average of the various values of z that are found in a given composition, which number has been rounded to the nearest integer. The range of z was determined by the gel permeation chromatography (GPC) analysis in the various examples and is indicated by the polydispersity (polydispersity=molecular weight based on the weight average divided by the molecular weight based on the number average).

When z is greater than 1, the individual $R_4$'s are the same or different. For example, if z is 20, each $R_4$ can be alkyl of four carbon atoms. Alternatively, the $R_4$'s can differ and for instance, independently be alkyl from two to four carbon atoms. When the $R_4$'s differ, they may be present in blocks, i.e., all z groups in which $R_4$ is alkyl of three carbon atoms will be adjacent, followed by all z groups in which $R_4$ is alkyl of two carbon atoms, followed by all z groups in which $R_4$ is alkyl of four carbon atoms. When the $R_4$'s differ, they may also be present in any random distribution.

Each $R_2$ is independently selected from alkyl of 2 to 20 carbon atoms. Preferably, each $R_2$ is independently selected from alkyl of 2 to 12 carbon atoms and more preferably 2 to 3 carbon atoms. The alkyl may be branched, but in the more preferred embodiments, especially when the $R_2$ is an alkyl of 2 to 3 carbon atoms, the alkyl will be linear.

In Formula I, x is from 0 to 10, preferably from 1 to 5, and even more preferably 1. Those of ordinary skill in the art will recognize that when the compounds of Formula I are utilized in a composition, x will not have a fixed value but will instead be represented by a range of different values. As used in this specification, x is considered to be a (number) average of the various values of x that are found in a given composition, which number has been rounded to the nearest integer and x is considered to be a (number) average of the various values of x that are found in a given composition, which number has been rounded to the nearest integer. This is indicated in the various examples by the polydispersity (polydispersity=molecular weight based on the weight average divided by the molecular weight based on the number average).

When x is greater than 1, the individual $R_2$'s are the same or different. For example, if x is 10, each $R_2$can be alkyl of four carbon atoms. Alternatively, the $R_2$'s can differ and for instance, independently be alkyl from two to four carbon atoms. When the $R_2$'s differ, they may be present in blocks, i.e., all x groups in which $R_2$ is alkyl of three carbon atoms will be adjacent, followed by all x groups in which $R_2$ is alkyl of two carbon atoms, followed by all x groups in which $R_2$ is alkyl of four carbon atoms. When the $R_2$'s differ, they may also be present in any random distribution.

Each $R_3$ is independently selected from alkyl of 2 to 20 carbon atoms. Preferably each $R_3$ is independently selected from alkyl of 2 to 12 carbon atoms. Preferred compounds are those in which $R_3$ is alkyl of 2 to 4 carbon atoms, especially alkyl of 4 carbon atoms.

Particularly preferred compounds of Formula I are those in which $R_3$ is alkyl (geminal or vicinal) of formula:

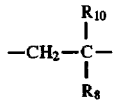

(V)

or

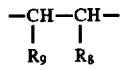

(VI)

wherein $R_8$, $R_9$ and $R_{10}$ are each independently hydrogen or alkyl of 1 to 18 carbon atoms. $R_{10}$ and $R_9$, or alternatively $R_9$ and $R_{11}$, may be taken together to form a divalent linking alkyl group of 3 to 12 carbon atoms.

The more preferred compounds of Formula I are those in which $R_3$ is represented by Formula V above wherein $R_{10}$ is hydrogen and $R_8$ is independently hydrogen or alkyl of 1 to 18 carbon atoms, particularly those compounds where $R_{10}$ is hydrogen and $R_8$ is independently hydrogen or alkyl of 1 to 2 carbon atoms, especially those compounds where $R_{10}$ is hydrogen and $R_8$ is alkyl of two carbon atoms.

In Formula I, y is from 1 to 50, preferably from 1 to 5 40, and even more preferably from 1 to 26. Those of ordinary skill in the art will recognize that when the compounds of Formula I are utilized in a composition, y will not have a fixed value but will instead be represented by a range of different values. As used in this specification, y is considered to be a (number) average of the various values of y that are found in a given composition, which number has been rounded to the nearest integer and y is considered to be a (number) average of the various values of y that are found in a given composition, which number has been rounded to the nearest integer. This is indicated in the various examples by the polydispersity (polydispersity=molecular weight based on the weight average divided by the molecular weight based on the number average).

When y is greater than 1, the individual $R_3$'s are the same or different. For example, if y is 20, each $R_3$ can be alkyl of four carbon atoms. Alternatively, the $R_3$'s can differ and for instance, independently be alkyl from two to four carbon atoms. When the $R_3$'s differ, they may be present in blocks, i.e., all y groups in which $R_3$ is alkyl of three carbon atoms will be adjacent, followed by all y groups in which $R_3$ is alkyl of two carbon atoms, followed by all y groups in which $R_3$ is alkyl of four carbon atoms. When the $R_3$'s differ, they may also be present in any random distribution.

The compounds of Formula I have a total weight average molecular weight of at least 600. Preferably, the total weight average molecular weight is from about 800 to about 4000, even more preferably from about 800 to about 2000.

Typical compounds represented by Formula I include those listed by structure in Table 1.

TABLE 1

| Example No. | Product |
|---|---|
| 1 | $H\leftarrow OCH(CH_3)CH_2\rightarrow_z O-CH_2-CH_2-S-CH_2-CH_2-O\leftarrow CH_2-CH(CH_3)O\rightarrow_y H$ wherein y and z are each from 1 to 26. |
| 2 | $CH_3-S-CH_2-CH_2-O\leftarrow CH_2CH(CH_3)O\rightarrow_y H$ wherein y is from 1 to 26. |
| 3 | $CH_3-C(=O)-S-CH_2-CH_2-CH_2-O\leftarrow CH_2CH(CH_3)O\rightarrow_y H$ wherein y is from 1 to 26. |
| 4 | $H-S-CH_2-CH_2-CH_2-O\leftarrow CH_2CH(CH_3)O\rightarrow_y H$ wherein y is from 1 to 26. |

The compounds of Formula I are illustratively prepared by reacting hydroxyalkyl sulfides with one or more epoxides in the presence of a potassium compound or by reacting thioacetic acid with an allyl alkoxylate.

In one embodiment of the present invention, the compounds of Formula I are prepared using one or more epoxides and hydroxyalkyl sulfides represented by Formula VII:

$$R_{11}\text{-S-}(R_2\text{-O})_x\text{-H} \qquad \text{(VII)}$$

wherein $R_2$ and x are as defined hereinbefore and $R_{11}$ is selected from alkyl, aryl and hydroxyalkyls. Non-limiting examples of hydroxyalkyl sulfides which are suitably employed include 2,2'-thiodiethanol, 2-(methylthio)ethanol and 2-(ethylthio)ethanol.

The hydroxyalkyl sulfides utilized are also available commercially and can be prepared by any of the methods known and described in the art.

The one or more epoxides employed in the reaction with the initiators to prepare the compounds of Formula I contain from 2 to 20 carbon atoms, more preferably from 2 to 4 carbon atoms, and most preferably four carbon atoms. The epoxides may be internal epoxides such as 2,3 epoxides of the formula:

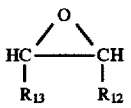

(VIII)

wherein $R_{13}$ and $R_{12}$ are each independently selected from hydrogen or alkyl of 1 to 18 carbon atoms or terminal epoxides such as 1,2 epoxides of the formula:

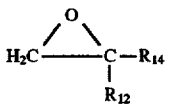

(IX)

wherein $R_{12}$ and $R_{14}$ are each independently selected from hydrogen or alkyl of 1 to 18 carbon atoms. Preferably, $R_{12}$, $R_{13}$ and $R_{14}$ are selected from hydrogen and alkyl of 1 to 2 carbon atoms, especially 2 carbon atoms. $R_{13}$ and $R_{12}$, or alternatively $R_{12}$ and $R_{14}$, may be taken together to form a cycloalkylene epoxide or a vinylidene epoxide by forming a divalent linking group of 3 to 12 carbon atoms.

In the preferred embodiment, the terminal epoxides represented by Formula IX are utilized. Ideally these terminal epoxides are 1,2-epoxyalkanes. Suitable 1,2-epoxyalkanes include 1,2-epoxyethane, 1,2-epoxypropane, 1,2-epoxybutane, 1,2-epoxydecane, 1,2-epoxydodecane, 1,2-epoxyhexadecane, 1,2-epoxyoctadecane and mixtures thereof.

In a typical preparation of Formula I compounds, the one or more epoxides and initiator are contacted at a ratio from about 7:1 to about 55:1 moles of epoxide per mole of initiator. Preferably, they are contacted at a molar ratio from about 10:1 to about 30:1, with the most preferred molar ratio being about 20:1.

The reaction is carried out in the presence of potassium compounds which act as alkoxylation catalysts. Such catalysts are conventional and include potassium methoxide, potassium ethoxide, potassium hydroxide, potassium hydride and potassium-t-butoxide. The preferred catalysts are potassium hydroxide and potassium-t-butoxide. The catalysts may be used in the presence of a base stable solvent such as alcohol, ether or hydrocarbons. The catalysts are employed in a wide variety of concentrations. Generally, the potassium compounds will be used in an amount from about 0.02% to about 5.0% of the total weight of the mixture, preferably from about 0.1% to about 2.0% of the total weight of the mixture, and most preferably about 0.2% of the total weight of the mixture. In addition, sodium compounds such as sodium metal, sodium hydride and sodium alkoxides may also be used as alkoxylation catalysts.

The reaction is conveniently carried out in a conventional autoclave reactor equipped with heating and cooling means. The process is practiced batchwise, continuously or semi-continuously.

The manner in which the alkoxylation reaction is conducted is not critical to the invention. Illustratively, the initiator and potassium compound are mixed and heated under vacuum for a period of at least 30 minutes. The one or more epoxides are then added to the resulting mixture, the reactor sealed and pressurized with nitrogen, and the mixture stirred while the temperature is gradually increased.

The temperature for alkoxylation is from about 80° C. to about 250° C., preferably from about 100° C. to about 150° C., and even more preferably from about 120° C. to about 140° C. The alkoxylation reaction time is generally from about 2 to about 20 hours, although longer or shorter times are employed.

Alkoxylation processes of the above type are known and are described, for example in U.S. Pat. No. 4,973,414, U.S. Pat. No. 4,883,826, U.S. Pat. No. 5,123,932 and U.S. Pat. No. 4,612,335, each incorporated herein by reference.

The product of Formula I is normally liquid and is recovered by conventional techniques such as filtration and distillation. The product is used in its crude state or is purified, if desired, by conventional techniques such as aqueous extraction, solid absorption and/or vacuum distillation to remove any remaining impurities.

In a second embodiment of the present invention, the compounds of Formula I are prepared by reacting thioacetic acid with an allyl alkoxylate of the general formula:

$$CH_2{=}CH{-}CH_2{-}O{-}(R_3{-}O)_yH$$

wherein $R_3$ and y are as defined hereinbefore in the presence of a catalyst. Non-limiting examples of allyl alkoxylates which may be employed include: allyl alcohol ethoxylate, allyl alcohol propoxylate and allyl alcohol butoxylate.

The allyl alkoxylates utilized can also be prepared by any of the methods known and described in the art, including the method described hereinbefore.

In the typical preparation of Formula I compounds, the thioacetic acid and allyl alkoxylate are contacted at a ratio from about 1.0 to about 2.0 moles of thioacetic acid per mole of allyl alkoxylate. Preferably, they are contacted at a molar ratio from about 1.2 to about 1.8, with the most preferred molar ratio being about 1.76:1.

The reaction is carried out in the presence of a catalyst. Typically the catalyst will be selected from free radical catalysts and acidic catalysts. Free radical catalysts which may be used include azobisisobutyronitrile (AIBN). Acidic catalysts which may be used include toluene sulfonic acid. The preferred catalyst is azobisisobutyronitrile. The catalysts are employed in a wide variety of concentrations. Generally, the free radical catalysts will be used in an amount from about 0.2 to about 1.0 of the total weight of the mixture, preferably from about 0.4 to about 0.8 of the total weight of the mixture, and most preferably about 0.5 of the total weight of the mixture.

The reaction is conveniently carried out in a multinecked flask equipped with a condenser, overhead stirrer, thermowell, pressure equalized dropping funnel and $N_2$ inlet. The process is conveniently practiced batchwise.

The manner in which the reaction is conducted is illustratively, by adding the allyl alkoxylate to multinecked flask and heating the allyl alkoxylate under nitrogen atmosphere. The thioacetic acid and catalyst are mixed and then added dropwise to the allyl alkoxylate. The mixture is then heated for an additional period of time.

The temperature for heating applied is from about 70° C. to about 90° C. preferably from about 72° C. to about 88° C. and even more preferably from about 75° C. to about 85° C. The reaction time is generally from about 0.5 to about 1.0 hours, although longer or shorter times are employed.

The product of Formula I is normally liquid and is recovered by conventional techniques such as filtration and distillation. The product is used in its crude state or is purified, if desired, by conventional techniques such as aqueous extraction, solid absorption and/or vacuum distillation to remove any remaining impurities.

FUEL COMPOSITIONS

The compounds of Formula I are useful as additives in fuel compositions which are burned or combusted in internal combustion engines. The fuel compositions of the present invention comprise a major amount of a mixture of hydrocarbons in the gasoline boiling range and a minor amount of one or more of the compounds of Formula I. As used herein, the term "minor amount" means less than about 10% by weight of the total fuel composition, preferably less than about 1% by weight of the total fuel composition and more preferably less than about 0.1% by weight of the total fuel composition.

Suitable liquid hydrocarbon fuels of the gasoline boiling range are mixtures of hydrocarbons having a boiling range of from about 25° C. to about 232° C., and comprise mixtures of saturated hydrocarbons, olefinic hydrocarbons and aromatic hydrocarbons. Preferred are gasoline mixtures having a saturated hydrocarbon content ranging from about 40% to about 80% by volume, an olefinic hydrocarbon content from 0% to about 30% by volume and an aromatic hydrocarbon content from about 10% to about 60% by volume. The base fuel is derived from straight run gasoline, polymer gasoline, natural gasoline, dimer and trimerized olefins, synthetically produced aromatic hydrocarbon mixtures, or from catalytically cracked or thermally cracked petroleum stocks, and mixtures of these. The hydrocarbon composition and octane level of the base fuel are not critical. The octane level, (R+M)/2, will generally be above about 85.

Any conventional motor fuel base can be employed in the practice of the present invention. For example, hydrocarbons in the gasoline can be replaced by up to a substantial amount of conventional alcohols or ethers, conventionally known for use in fuels. The base fuels are desirably substantially free of water since water could impede a smooth combustion.

Normally, the hydrocarbon fuel mixtures to which the invention is applied are substantially lead-free, but may contain minor amounts of blending agents such as methanol, ethanol, ethyl tertiary butyl ether, methyl tertiary butyl ether, and the like, at from about 0.1% by volume to about 15% by volume of the base fuel, although larger amounts may be utilized. The fuels can also contain conventional additives including antioxidants such as phenolics, e.g., 2,6-di-tert-butylphenol or phenylenediamines, e.g., N,N'-di-sec-butyl-p-phenylenediamine, dyes, metal-deactivators, dehazers such as polyester-type ethoxylated alkylphenol-formaldehyde resins. Corrosion inhibitors, such as a polyhydric alcohol ester of a succinic acid derivative having on at least one of its alpha-carbon atoms an unsubstituted or substituted aliphatic hydrocarbon group having from 20 to 500 carbon atoms, for example, pentaerythritol diester of polyisobutylene-substituted succinic acid, the polyisobutylene group having an average molecular weight of about 950, in an amount from about 1 parts per million (ppm) by weight to about 1000 ppm by weight, may also be present. The fuels can also contain antiknock compounds such as methyl cyclopentadienylmanganese tricarbonyl and ortho-azidophenol as well as co-antiknock compounds such as benzoyl acetone.

An effective amount of one or more compounds of Formula I are introduced into the combustion zone of the engine in a variety of ways to prevent build-up of deposits, or to accomplish the reduction of intake valve deposits or the modification of existing deposits that are related to octane requirement. As mentioned, a preferred method is to add a minor amount of one or more compounds of Formula I to the fuel. For example, one or more compounds of Formula I are added directly to the fuel or are blended with one or more carriers and/or one or more additional detergents to form an additive concentrate which can be added at a later date to the fuel.

The amount of the one or more compounds of Formula I used will depend on the particular variation of Formula I used, the engine, the fuel, and the presence or absence of carriers and additional detergents. Generally, each compound of Formula I is added in an amount up to about 1000 ppm by weight, especially from about 1 ppm by weight to about 600 ppm by weight based on the total weight of the fuel composition. Preferably, the amount will be from about 50 ppm by weight to about 400 ppm by weight, and even more preferably from about 75 ppm by weight to about 250 ppm by weight based on the total weight of the fuel composition.

The carrier, when utilized, will have a weight average molecular weight from about 500 to about 5000. Suitable carriers, when utilized, include hydrocarbon based materials such as polyisobutylenes (PIB's), polypropylenes (PP's) and polyalphaolefins (PAO's); polyether based materials such as polybutylene oxides (poly BO's), polypropylene oxides (poly PO's), polyhexadecene oxides (poly HO's) and mixtures thereof (i.e., both (poly BO)+(poly PO) and (poly-BO-PO)); and mineral oils such as Exxon Naphthenic 900 sus and high viscosity index (HVI) oils. The carrier is preferably selected from PIB's, poly BO's, and poly PO's, with poly BO's being the most preferred.

The carrier concentration in the final fuel composition is up to about 1000 ppm by weight. When a carrier is present, the preferred concentration is from about 50 ppm by weight to about 400 ppm by weight, based on the total weight of the fuel composition. Once the carrier is blended with one or more compounds of Formula I, the blend is added directly to the fuel or packaged for future use.

DECREASING INTAKE VALVE DEPOSITS

The invention further provides a process for decreasing intake valve deposits in engines utilizing the compounds of the present invention. The process comprises supplying to and combusting or burning in an internal combustion engine a fuel composition comprising a major amount of hydrocarbons in the gasoline boiling range and a minor amount of one or more compounds of Formula I as described hereinbefore.

By supplying to and combusting or burning the fuel composition in an internal combustion engine, deposits in the induction system, particularly deposits on the tulips of the intake valves, are reduced. The reduction is determined by running an engine with clean induction system components and pre-weighed intake valves on dynamometer test stands in such a way as to simulate road operation using a variety of cycles at varying speeds while carefully controlling specific operating parameters. The tests are run for a specific period of time on the fuel composition to be tested. Upon completion of the test, the induction system deposits are visually rated, the valves are reweighed and the weight of the valve deposits is determined.

The ranges and limitations provided in the instant specification and claims are those which are believed to particularly point out and distinctly claim the instant invention. It is, however, understood that other ranges and limitations that perform substantially the same function in substantially the same way to obtain the same or substantially the same result are intended to be within the scope of the instant invention as defined by the instant specification and claims.

The invention will be described by the following examples which are provided for illustrative purposes only and are not to be construed as limiting the invention.

EXAMPLES

The sulfur-containing compounds used in the following examples were prepared by reacting an initiator with one or more epoxides in the presence of a potassium compound or by reacting thioacetic acid with an allyl alkoxylate to produce compounds of Formula I having a weight average molecular weight from about 600 to about 400. Weight average molecular weights (MW) were determined by gel permeation chromatography (GPC).

Example 1

2,2'-Thiodiethanol Butoxylate

A mixture of 24.4 grams (0.2 mole) of 2,2'-thiodiethanol and 0.75 grams (0.011 mole) of 85% potassium hydroxide pellets was stirred at 120° C. under nitrogen gas flow for one hour in a 50 ml flask. The resulting mixture was transferred to a 500 ml autoclave equipped with a heating device, temperature controller, mechanical stirrer and water cooling system. 296 grams (4.1 moles) of butene oxide was added to the autoclave. The autoclave was sealed and residual air removed by several pressure/depression cycles using nitrogen gas. Approximately 200 psig of nitrogen was added to the autoclave and the contents were heated to 120° C. for six hours. The reaction product was neutralized with 0.7 grams of glacial acetic acid and unreacted butene oxide was removed in vacuo, affording 305 grams of a clear, pale yellow oil.

Catalyst residues and residual water soluble matter were removed by the following extraction method: the crude reaction mixture (305 grams) was dissolved in 500 ml of hexane and then washed three times using 500 ml of distilled water. The organic layer was dried using magnesium sulfate, and the hexane was removed via rotary evaporation. A total of 300 of a clear, pale yellow oil was isolated. The structure of the compound was confirmed by $C^{13}$ NMR analysis. GPC analysis of the final product showed MW=1550.

Example 2

2-(methylthio)ethanol Butoxylate

Approximately 17.4 grams (0.189 mole) of 2-(methylthio)ethanol was treated with 0.5 grams of hexane-washed potassium hydride in a 50 ml flask in a nitrogen filled drybox. The solution was then added to a 500 ml autoclave (as described in Example 1) and diluted with 314 grams (4.36 moles) of butene oxide. The autoclave was sealed and residual air removed by several pressure/depression cycles using nitrogen gas. Approximately 200 psig of nitrogen was added to the autoclave and the contents were heated to 125° C. for twelve hours. The reaction product was neutralized with 0.8 grams of glacial acetic acid and unreacted butene oxide was removed in vacuo, affording 329 grams of a gold fluid oil.

Catalyst residues were removed by the same extraction method used in Example 1 to afford a total of 320 grams of clear, gold oil. The structure of the compound was confirmed by $C^{13}$ NMR analysis. GPC analysis of the final product showed MW=1750.

Example 3

3-thioacetoxy-1-propanol Butoxylate

A. Preparation of allyl alcohol butoxylate (Avg. MW=1668)

Approximately 10.5 grams (0.18 mole) of allyl alcohol, 1.2 grams (0.011) of potassium t-butoxide and 314 grams (4.36 moles) of butene oxide were added to a 500 ml autoclave (as described in Example 1). The autoclave was sealed and residual air removed by several pressure/depression cycles using nitrogen gas. Approximately 200 psig of nitrogen was added to the autoclave and the contents were heated to 120° C. for eight hours. The reaction product was neutralized with 0.64 grams of glacial acetic acid and unreacted butene oxide and allyl alcohol were removed in vacuo, affording 291 grams of a pale yellow oil. Catalyst residues were removed by the same extraction method used in Example 1 to afford a total of 241 grams of clear, pale yellow oil. The material was further purified by dissolving it in hexane and treating it with basic alumina to remove any residual impurities. Removal of the hexane produced a clear, colorless oil (170 grams). Analysis of the allyl alcohol butoxylate by $C^{13}$ NMR confirmed the structure. GPC analysis of the final product showed MW=1668.

B. Addition of thiolacetic acid to allyl alcohol butoxylate:

Approximately 169 grams (1.0 mole) of allyl alcohol butoxylate was added to a 2000 ml multineck flask fitted with a condenser, overhead stirrer, thermowell, pressure equalized dropping funnel and nitrogen inlet. 0.73 grams (0.043 mole) of AIBN was then added to 13.6 grams (1.76 moles) of thiolacetic acid. This clear yellow solution was then added to the dropping funnel of the flask which contained the allyl alcohol butoxylate. After flushing the system with nitrogen, the butoxylate was heated to 80° C. At this point, the AIBN/thiolacetic acid solution was added dropwise to the well stirred reaction mixture. After all of the solution was added, the reaction was cooled to 25° C. and was extracted with hexane/water to remove residual thiolacetic acid and AIBN. The hexane layer was extracted two times with distilled water, followed by washing with 5% aqueous sodium bicarbonate. After two additional water washed, the hexane fraction was dried with magnesium sulfate. Hexane was removed in vacuo affording 165 grams of a clear, yellow oil. The structure was confirmed via IR and $C^{13}$ NMR analysis. GPC analysis of the final product showed MW=1740.

Example 4

3-thio-1-propanol Butoxylate

Approximately 429 grams (0.25 mole) of Example 3 (3-thioacetoxy-1-propanol butoxylate) was added to a 5-liter 4-neck flask fitted with an overhead stirrer, condenser, thermowell and nitrogen inlet. 1430 ml of ethanol was added to dissolve the butoxylate. A solution of 20.1 grams (0.304 mole) of 85% potassium hydroxide was dissolved in 280 ml of distilled water and added to the reaction flask thereby producing a clear reddish amber solution. The reaction mixture was stirred at ambient temperature for one hour, after which time IR analysis of the mixture showed no carbonyl peaks. The reaction mixture was neutralized to a pH of 7.0 using glacial acetic acid, causing a color change from reddish to yellow. Ethanol was removed from the crude reaction mixture via rotary evaporation and the residue was dissolved in hexane and water washed as described Example 1. Removal of the hexane afforded 401 grams of a clear, yellow oil. The structure was confirmed using IR and $C^{13}$ NMR analysis. GPC analysis of the final product indicated a MW=1680.

TEST RESULTS

In the following tests, the base fuel utilized comprised either premium unleaded gasoline (PU) (90+ octane, [R+M/2]) and/or regular unleaded gasoline (RU) (85–88 octane, [R+M/2]). Those skilled in the art will recognize that fuels containing heavy catalytically cracked stocks, such as most regular fuels, are typically more difficult to additive in order to control deposits and effectuate octane requirement reduction and octane requirement increase control. The compounds utilized were prepared as indicated by Example number and were used at the concentration indicated in ppm by weight. The tests employed are described below and the results of the various tests are set forth in the tables below.

Intake Valve Deposit Tests

Engines from vehicles were installed in dynamometer cells in such a way as to simulate road operation using a cycle of idle, low speed and high speed components while carefully controlling specific operating parameters. Fuels with and without the compounds of Formula I were tested in 3.3 L Dodges and 3.0 L Fords having port fuel injection to determine the effectiveness of the compounds of the present invention in reducing intake valve deposits ("L" refers to liter). Carbureted 0.359 L Honda generator engines were also utilized to determine the effectiveness of the compounds of the present invention in reducing intake valve deposits.

Before each test, the engine was inspected, the induction system components were cleaned and new intake valves were weighed and installed. The oil was changed and new oil and fuel filters, gaskets and spark plugs were installed.

In all engines except the Honda, the tests were run in cycles consisting of idle, 35 mph and 65 mph for a period of 100 hours unless indicated otherwise. In the Honda engines, the tests were run in cycles consisting of a no load idle mode for one minute followed by a three minute mode with a load-at 2200 rpm's for a period of 40 hours unless indicated otherwise. At the end of each test, the intake valves were removed and weighed.

Results obtained using the compound of the present invention are included in the tables below. All tests of the compounds of the present invention were carried out with additive concentrations (the amount of Compound Example # used) of 200 ppm non-volatile matter (nvm). Base Fuel results which have 0 ppm additive are also included for comparison purposes. The base fuels are indicated by the absence of a Compound Example # (indicated in the Compound Example # column by - - - ).

TABLE 2

Intake Valve Deposits in Honda Generator Engines

| Compound Example # | Fuel | Compound Dosage | Engine | Avg. Deposit Wt. (mg) |
|---|---|---|---|---|
| 1 | PU | 200 | H2 | 9.7 |
| 2 | " | " | " | 8.8 |
| 3 | " | " | " | 13.8 |
| 4 | " | " | " | 5.4 |
| — | " | 0 | " | 57.1 |
| 2 | RU | 200 | H2 | 30.4 |
| 3 | " | " | " | 26.9 |
| 4 | " | " | " | 54.3 |
| — | " | 0 | " | 38.6 |

—Indicates the results achieved with base fuel in the absence of any additive compound (0 ppm additive compound).

TABLE 3

Intake Valve Deposits in Various Engines

| Compound Example # | Engine | Fuel | Concentration ppm By Wt | Avg. Deposit Wt (mg) |
|---|---|---|---|---|
| 2 | 3.3 L DODGE | PU | 200 | 57.0 |
| 4 | 3.3 L DODGE | " | " | 102.0 |
| — | 3.3 L DODGE | " | 0 | 188.0 |
| 2 | 3.0 L FORD | RU | 100 | 364.0 |
| 3 | 3.0 L FORD | " | " | 178.0 |
| — | 3.0 L FORD | " | 0 | 375.0 |

—Indicates the results achieved with base fuel in the absence of any additive compound (0 ppm additive compound).

What is claimed is:

1. A fuel composition comprising a mixture of a major amount of hydrocarbons in the gasoline boiling range and from about 50 ppm by weight to about 400 ppm by weight of the fuel composition of an additive compound having the formula:

$$R_1\text{-S-}(R_2\text{-O})_x\text{-}(R_3\text{-O})_y\text{-H}$$

wherein $R_1$ is acyl of 2 to 20 carbon atoms;

each $R_2$ is selected from alkyl of 2 to 12 carbon atoms;

each $R_3$ is alkyl of the formula:

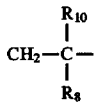

wherein $R_8$ and $R_{10}$ are each independently selected from the group consisting of hydrogen and alkyl of 1 to 18 carbon atoms;

x is from 1 to 5;

y is from 1 to 50; and the weight average molecular weight of the additive compound is from about 800 to about 4000.

2. The fuel composition of claim 1 wherein y is from 1 to 26; each $R_8$ is independently selected from the group consisting of hydrogen and alkyl of 1 to 2 carbon atoms; and each $R_{10}$ is independently selected from the group consisting of hydrogen and alkyl of 1 to 2 carbon atoms.

3. The fuel composition of claim 2 wherein x is 1; $R_2$ is alkyl of 3 carbon atoms; and $R_1$ is acyl of 2 carbon atoms.

4. A fuel composition comprising a mixture of a major mount of hydrocarbons in the gasoline boiling range and from about 50 ppm by weight to about 400 ppm by weight of the fuel composition of an additive compound having the formula:

$$R_1\text{-S-}(R_2\text{-O})_x\text{-}(R_3\text{-O})_y\text{-H}$$

wherein $R_1$ is polyoxyalkylene of the formula:

$$H\text{-}(O\text{-}R_4)_z$$

wherein $R_4$ is alkyl of the formula:

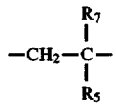

wherein $R_5$ and $R_7$ are each independently selected from the group consisting of hydrogen and alkyl of 1 to 18 carbon atoms;

each $R_2$ is selected from alkyl of 2 to 12 carbon atoms;

each $R_3$ is alkyl of the formula:

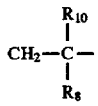

wherein $R_8$ and $R_{10}$ are each independently selected from the group consisting of hydrogen and alkyl of 1 to 18 carbon atoms;

x is from 1 to 5;

y is from 1 to 50;

z is from 1 to 50; and the weight average molecular weight of the additive compound is from about 800 to about 4000.

5. The fuel composition of claim 4 wherein y and z are each from 1 to 26; each $R_8$ is independently selected from the group consisting of hydrogen and alkyl of 1 to 2 carbon atoms; each $R_{10}$ is independently selected from the group consisting of hydrogen and alkyl of 1 to 2 carbon atoms; each $R_5$ is independently selected from the group consisting of hydrogen and alkyl of 1 to 2 carbon atoms; and each $R_7$ is independently selected from the group consisting of hydrogen and alkyl of 1 to 2 carbon atoms.

6. The fuel composition of claim 5 wherein x is 1 and $R_2$ is alkyl of 2 carbon atoms.

7. A method for reducing intake valve deposits in an internal combustion engine which comprising burning in said engine a fuel composition comprising a mixture of a major mount of hydrocarbons in the gasoline boiling range and from about 50 ppm by weight to about 400 ppm by weight based on the fuel composition of an additive compound having the formula:

$$R_1\text{-S-}(R_2\text{-O})_x\text{-}(R_3\text{-O})_y\text{-H}$$

wherein $R_1$ is acyl of 2 to 20 carbon atoms;

each $R_2$ is selected from alkyl of 2 to 12 carbon atoms;

each $R_3$ is alkyl of the formula:

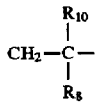

wherein $R_8$ and $R_{10}$ are each independently selected from the group consisting of hydrogen and alkyl of 1 to 18 carbon atoms;

x is from 1 to 5;

y is from 1 to 50; and the weight average molecular weight of the additive compound is from about 800 to about 4000.

8. The method of claim 7 wherein y is from 1 to 26; each $R_8$ is independently selected from the group consisting of hydrogen and alkyl of 1 to 2 carbon atoms; and each $R_{10}$ is independently selected from the group consisting of hydrogen and alkyl of 1 to 2 carbon atoms.

9. The method of claim 8 wherein x is 1; $R_2$ is alkyl of 3 carbon atoms; and $R_1$ is acyl of 2 carbon atoms.

10. A method for reducing intake, valve deposits in an internal combustion engine which comprising burning in said engine a fuel composition comprising a mixture of a major mount of hydrocarbons in the gasoline boiling range and from about 50 ppm by weight to about 400 ppm by weight based on the fuel composition of an additive compound having the formula:

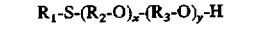

$$R_1\text{-S-}(R_2\text{-O})_x\text{-}(R_3\text{-O})_y\text{-H}$$

wherein $R_1$ is polyoxyalkylene of the formula:

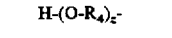

$$\text{H-}(\text{O-}R_4)_z\text{-}$$

wherein $R_4$ is alkyl of the formula

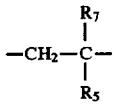

wherein $R_5$ and $R_7$ are each independently selected from the group consisting of hydrogen and alkyl of 1 to 18 carbon atoms;

each $R_2$ is selected from alkyl of 2 to 12 carbon atoms;

each $R_3$ is alkyl of the formula:

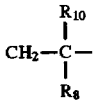

wherein $R_8$ and $R_{10}$ are each independently selected from the group consisting of hydrogen and alkyl of 1 to 18 carbon atoms;

x is from 1 to 5;

y is from 1 to 50;

z is from 1 to 50; and the weight average molecular weight of the additive compound is from about 800 to about 4000.

11. The method of claim 10 wherein y and z are each from 1 to 26; each $R_8$ is independently selected from the group consisting of hydrogen and alkyl of 1 to 2 carbon atoms; each $R_{10}$ is independently selected from the group consisting of hydrogen and alkyl of 1 to 2 carbon atoms; each $R_5$ is independently selected from the group consisting of hydrogen and alkyl of 1 to 2 carbon atoms; and each $R_7$ is independently selected from the group consisting of hydrogen and alkyl of 1 to 2 carbon atoms.

12. The method of claim 11 wherein x is 1 and $R_2$ is alkyl of 2 carbon atoms.

* * * * *